United States Patent [19]

Anderson et al.

[11] Patent Number: 4,479,764

[45] Date of Patent: Oct. 30, 1984

[54] DEMAND RESPONSIVE HYDRAULIC PUMP

[75] Inventors: Stanley E. Anderson, Saginaw; Leonard N. Franklin, Jr., Reese, both of Mich.

[73] Assignee: General Motors Corporation, Detroit, Mich.

[21] Appl. No.: 473,660

[22] Filed: Mar. 9, 1983

[51] Int. Cl.[3] ..... F04B 49/02; F04B 49/08

[52] U.S. Cl. ..... 417/299; 417/310

[58] Field of Search ..... 417/283, 284, 299, 310

[56] References Cited

U.S. PATENT DOCUMENTS 2,193,244 3/1940 Wolcott ..... 417/299

2,362,724 11/1944 Shea ..... 417/299 X

*Primary Examiner*—Richard E. Gluck

*Attorney, Agent, or Firm*—Donald F. Scherer

[57] ABSTRACT

A hydraulic power steering system has a vane type pump which is operable to supply fluid to a power steering gear at a volumetric rate determined in part by the system pressure requirement or system demand. The pump flow is partially bypassed through an aperture in the cam ring at low system pressures. The bypass flow is controlled by a sleeve valve surrounding the cam ring and being subjected to system pressure to incrementally close the aperture and reduce bypass flow and simultaneously increase the output flow. At a predetermined system pressure, the valve is moved sufficiently to control reopening of the aperture for controlled bypass flow to limit the maximum system pressure.

2 Claims, 1 Drawing Figure

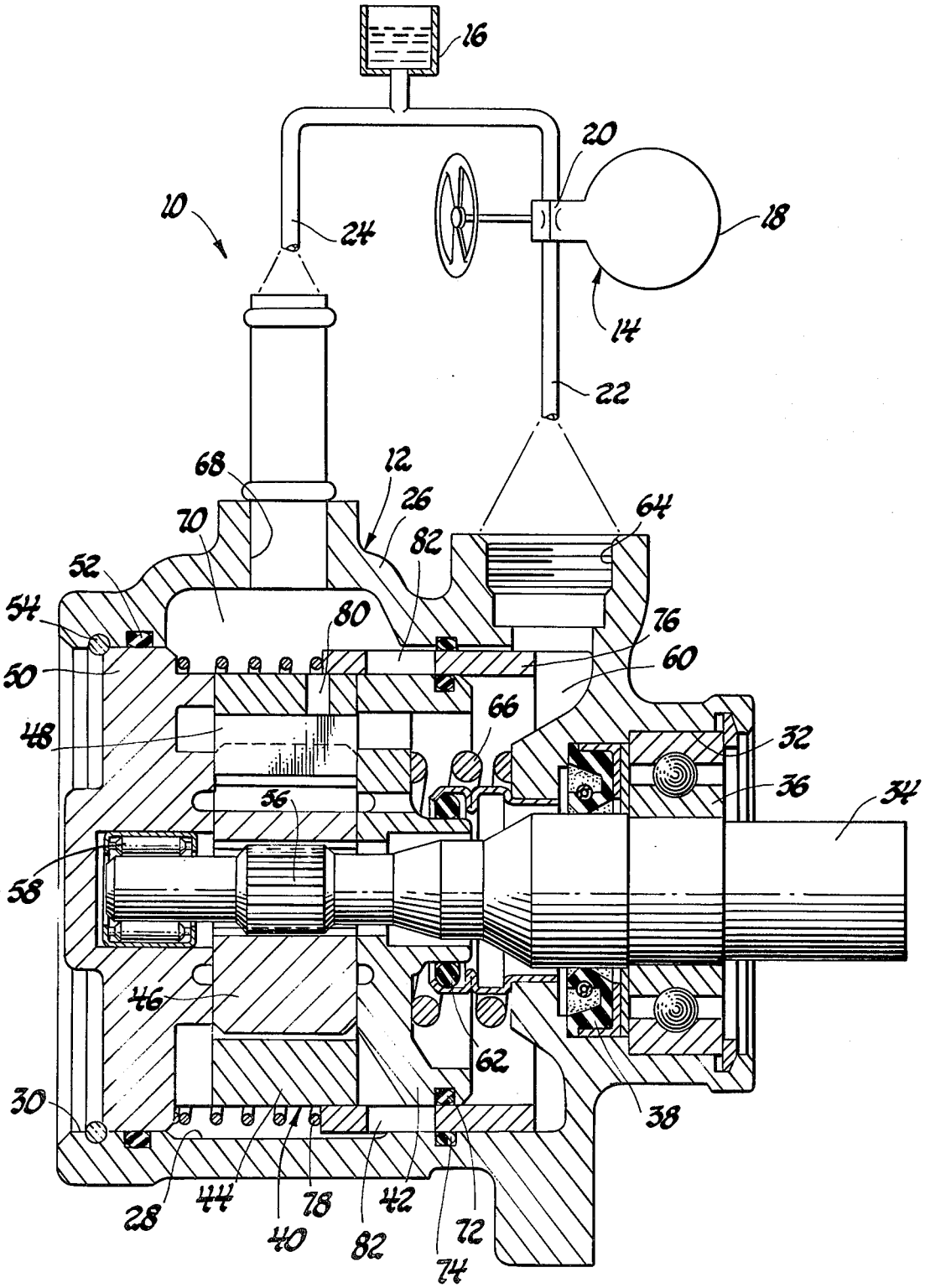
16
20
10
24
18
14
22
68
12
26
64
70
82
52
54
80
76
50
60
66
48
32
36
34
56
58
46
62
30
38
28
44
78
42
40
82
72
74

DEMAND RESPONSIVE HYDRAULIC PUMP

This invention relates to hydraulic pumps and more particularly to demand responsive control mechanisms for hydraulic pumps.

When a vehicle is equipped with a power steering system, the hydraulic pump is a parasitic loss within the system whenever a turning maneuver is not occurring. Many efforts have been made to reduce these losses. These efforts have generally resulted in the use of flow controlled type pumps which limit the fluid volume delivered to the steering gear thereby limiting the back pressure within the system.

The present invention seeks to reduce the losses by reducing the flow to the steering gear whenever a steering demand is not present. When a steering demand becomes present, the system will discharge the fluid required to satisfy the demand with the remaining fluid being bypassed. This differs from a flow controlled system in that the flow to the steering gear is continually limited regardless of demand.

It is therefore an object of this invention to provide an improved hydraulic pump having a demand responsive valve mechanism incorporated therein wherein the valve mechanism includes a sleeve valve disposed adjacent the outer surface of the pump cam ring. The sleeve valve is responsive to system pressure to control the amount of fluid bypassed from the pumping chambers through an aperture in the cam ring thereby controlling the discharge flow to a power steering system.

It is another object of this invention to provide an improved demand responsive vane type hydraulic pump wherein the cam ring of the pump has one or more radially extending apertures which are aligned with the pumping chambers in the discharge cycle and are also in communication with a pump inlet to bypass pump flow directly to pump inlet and wherein a sleeve valve is disposed around the periphery of the cam ring and is spring-biased to permit the bypass flow and also wherein, the sleeve valve is subjected to pump discharge pressure such that upon an increase in discharge pressure, the sleeve valve is moved against the spring bias to incrementally close the bypass apertures, thereby reducing bypass flow while increasing pump discharge flow.

These and other objects and advantages of the present invention will be more readily apparent from the following description and drawing which is a cross-sectional elevational view of a power steering pump and a diagrammatic view of a power steering system.

The power steering system 10 includes a vane type hydraulic pump, generally designated 12, a steering gear assembly, generally designated 14, and a fluid reservoir 16. The steering gear assembly 14 includes a power-assisted steering gear 18 and a steering valve 20. The steering gear assembly 14 may be constructed in accordance with the steering gear assembly shown in U.S. Pat. No. 3,022,772 issued Feb. 27, 1962, to Zeigler, and assigned to the assignee of this application.

The vane type pump 12 is connected through a pump discharge passage 22 to the steering valve 20 such that pressurized fluid from the pump 12 is delivered to the steering gear assembly 14. The steering valve 20 and reservoir 16 are both connected to the pump 12 through a pump return or inlet passage 24.

The vane type pump 12 includes a pump housing 26 having an internal housing cavity 28 with a large opening 30 at one end thereof and a smaller opening 32 at the other end thereof. A drive shaft 34 extends through the smaller opening 32 and is rotatably supported in a shaft bearing 36 which is secured in the opening 32 and is contacted by a shaft seal 38 also secured in the opening 32. The shaft seal 38 functions to prevent atmospheric air from entering the pump and low pressure fluid leakage from the pump.

The housing cavity 28 is substantially filled with a vane pump assembly, generally designated 40, and including a pressure plate 42, a cam ring 44, a rotor 46, a plurality of vanes 48 and an end cover and thrust plate 50. The end cover and thrust plate 50 cooperates with an annular seal ring 52 and a locking ring 54 to close the large opening 30.

The rotor 46 includes a plurality of slots in which the vanes 48 are slidably disposed in a well-known manner. The vanes 48 contact the inner surface of cam ring 44 so as to provide a plurality of peripheral pumping chambers which expand and contract upon the rotation of rotor 46 when it is driven through a spline connection 56 by the drive shaft 34.

The end cover and thrust plate 50 and pressure plate 42 establish the axial limits of the peripheral pump chambers and also includes pump inlet and discharge porting arrangements disposed in a well-known manner. The end cover and thrust plate 50 supports a shaft bearing 58 in which is rotatably supported the left end of drive shaft 34.

The discharge from the pumping chambers of the vane pump assembly 40 passes through pressure plate 42 to a discharge space 60 formed between the right end of cavity 28 and the left end surface of pressure plate 42. Leakage to the drive shaft 34 from the discharge space 60 is prevented by an annular seal ring 62. The discharge space 60 is in fluid communication with a pump discharge port 64 which in turn is in fluid communication with the pump discharge passage 22.

To ensure that the vane pump assembly 40 is urged into abutment with the locking ring 54, an assist spring 66 disposed in the discharge space 60 is provided. Thus, even at atmospheric pressure within the discharge space 60 there is a leftward force provided which continually urges the pump vane assembly 40 toward the locking ring 54.

The pump inlet passage 24 is connected with a pump inlet port 68 which in turn communicates with an inlet space 70 which surrounds the cam ring 44 in the housing cavity 28. The inlet space 70 communicates fluid from the return passage 24 to the inlet porting of the vane pump assembly 40. The inlet space 70 is sealed from direct communication with the discharge space 60 by an annular seal ring 72 disposed in the pressure plate 42.

The inlet space 70 is also prevented from direct fluid communication with the discharge space 60 by an annular seal ring 74 which is disposed in the pump housing 26. Slidably disposed on the outer surface of pressure plate 42 between the seal rings 74 and 72, is a sleeve valve 76. The sleeve valve 76 is urged to the right by a valve spring 78 such that a bypass passage or aperture 80 formed in the cam ring 44 is open for fluid communication from the pump chambers of vane pump assembly 40 to the inlet space 70. Therefore, when the sleeve valve 76 is urged to the position shown by valve spring 78, a portion of the fluid within the pump chambers will be exhausted or bypassed directly to the inlet space 70 and the remaining portion of the pump fluid will be directed to the steering valve 20 through discharge space 60 and discharge passage 22.

The valve sleeve 76 has a plurality of radial apertures 82 which are formed therein. The outer portion of apertures 82 is in fluid communication with the inlet space 70.

When the operator conditions the steering valve 20 for a steer maneuver, the pressure output from pump 12 will increase depending upon the steering effort required. The output pressure of the pump operates on the annular end surfaces of sleeve valve 76 disposed in the discharge space 60. As the pump pressure increases, the sleeve valve 76 is moved leftward against valve spring 78 to provide a decrease in the amount of discharge flow through bypass passage 80. As the bypass flow decreases, the pump discharge flow in passage 22 correspondingly increases.

Thus, the amount of fluid available for operation of the steering gear is automatically increased in response to system demand. When the pump discharge pressure reaches a predetermined level, the apertures 82 will be in such a position due to movement of the sleeve valve 76 so as to provide a bypass flow through bypass passages 80 to the inlet space 70. This will occur at very high system pressures such that a system relief pressure setting is provided.

The embodiments of the invention in which an exclusive property or privilege is claimed are defined as follows:

1. A demand responsive hydraulic fluid pump for power steering systems comprising; inlet port means; outlet port means; pump means including rotor means, cam ring means and vane means for accepting low pressure fluid from said inlet port means and delivering high pressure fluid to said outlet port means; said cam ring means having controlled aperture means for communicating high pressure fluid from said outlet port means to said inlet port means; and valve means including a sleeve member surrounding said cam ring means and having one end exposed to low inlet pressure and the other end exposed to high outlet pressure means and spring means engaging said sleeve member and acting in assisting relation to the inlet pressure, said valve means being normally conditioned for permitting fluid flow through said controlled aperture means and being responsive to pressure demand at said outlet port for reducing the flow through said controlled aperture means with increased outlet pressure so that increased output flow will occur.

2. A demand responsive hydraulic fluid pump for power steering systems comprising; inlet port means; outlet port means; pump means including rotor means, cam ring means and vane means for accepting low pressure fluid from said inlet port means and delivering high pressure fluid to said outlet port means; said cam ring means having controlled aperture means for communicating high pressure fluid from said outlet port means to said inlet port means; and valve means including a sleeve member slidably disposed on said cam ring means and having one end exposed to low inlet pressure and the other end exposed to high outlet pressure means and spring means abutting said sleeve member and acting in a direction against the outlet pressure, said valve means being normally conditioned for permitting fluid flow through said controlled aperture means and being responsive to pressure demand at said outlet port to overcome said spring means thereby reducing the flow through said controlled aperture means with increased outlet pressure so that increased output flow will occur.

* * * * *